United States Patent [19]

Bowerman et al.

[11] Patent Number: 4,724,574

[45] Date of Patent: Feb. 16, 1988

[54] SUCTION CLEANER

[75] Inventors: Leonard E. Bowerman, Abingdon, Va.; Daniel A. Peragine, Mt. Vernon, N.Y.; George C. Moyher, Bluff City, Tenn.

[73] Assignee: Sara Lee Corporation, Winston-Salem, N.C.

[21] Appl. No.: 28,178

[22] Filed: Mar. 19, 1987

[51] Int. Cl.[4] ..... A47L 9/10; A47L 5/28

[52] U.S. Cl. ..... 15/351; 15/410; 15/412; 55/373; 55/378; 55/DIG. 3

[58] Field of Search ..... 15/347, 350, 351, 352, 15/410, 412; 55/DIG. 3, 373, 378

[56] References Cited

U.S. PATENT DOCUMENTS

| | | |
|---|---|---|
| 2,269,482 | 1/1942 | Replogle . |
| 2,388,280 | 11/1945 | Nuffer et al. . |
| 2,823,761 | 2/1958 | Duff . |
| 2,876,481 | 3/1959 | Gerber et al. . |
| 3,226,758 | 1/1966 | Brown et al. . |
| 3,639,939 | 2/1972 | Crener et al. . |
| 4,001,912 | 1/1977 | Eriksson . |
| 4,129,920 | 12/1978 | Evans et al. . |
| 4,171,553 | 10/1979 | Stein . |
| 4,517,705 | 5/1985 | Hug . |
| 4,670,937 | 6/1987 | Sumerall et al. ..... 15/347 |

OTHER PUBLICATIONS

Instruction Manual–Hako Minuteman Model 140 Carpet Vacuum.

Instruction Sheets–Electronic 506 Cleaner.

*Primary Examiner*—Harvey G. Hershy

*Assistant Examiner*—Corinne M. Reinckens

*Attorney, Agent, or Firm*—Charles Y. Lackey; William S. Burden

[57] ABSTRACT

A lightweight, upright, top-loading vacuum cleaner wherein a seal between the disk of a filter bag and a duct for conveying dirt-laden air to the bag is provided adjacent the outer peripheral edges of the disk resulting in the disk becoming an integral part of the seal while eliminating pressure differential across opposite sides of the disk. A portion of the duct extending into the filter bag is capable of being displaced to an open position for filter bag loading and unloading and is normally closed to maintain the seal by a latch which cooperates with the handle vacuum cleaner handle. The vacuum cleaner handle includes electrical components having projections which are releasably received and supported within an electrical receptacle supported by the vacuum cleaner housing.

10 Claims, 12 Drawing Figures

SUCTION CLEANER

BACKGROUND, BRIEF SUMMARY AND OBJECTS OF THE INVENTION

This invention relates generally to a new and improved upright vacuum cleaner, and more particularly to a lightweight, clean-air, top-loading vacuum system.

In accordance with our invention, the vacuum cleaner includes a motor-driven brush located adjacent a suction nozzle and a conduit or duct means connecting the nozzle with a filter bag supported within the vacuum compartment of a housing. A motor-fan unit draws dust and dirt-laden air through the suction nozzle and the duct means and into a disposable filter bag. To provide convenient access to the vacuum compartment for replacement of filter bags, the uppermost portion of the housing defines a pivoted closure which is normally maintained in a sealed, locked position by the vacuum cleaner handle which, in turn, is electrically and mechanically connected to the housing in a novel manner.

It is well-known to provide a seal between the duct means carrying the dirty air and the disk of the filter bag. This type of sealing arrangement tends to bend and deform the bag disk due to a pressure differential on opposite sides of the disk and due to the sealing material applying pressure to the disk. In the sealing arrangement of the instant invention, pressures on opposite sides of the disk remain equal and the disk becomes an integral part of the sealing arrangement.

The housing includes a number of components of plastic construction, some of which are coupled together by interlocking snap fasteners which are integral with such components. Depending from the housing are trunnions for mounting vacuum cleaner wheels and for serving as a pivot to permit pivotal displacement of the housing relative to the motor-driven brush and suction nozzle.

One of the primary objects of the invention is the provision of a vacuum cleaner having a novel sealing arrangement between the filter bag disk and the vacuum duct.

Another object of the invention is the provision of a new and improved handle assembly for maintaining the seal between the filter bag disk and the vacuum duct and for electrically coupling the handle assembly to the vacuum housing.

A further object of the invention is the provision of a lightweight, top-loading cleaner of attractive appearance which can be economically constructed and which is reliably effective.

Other features and advantages of the invention will be readily apparent to those skilled in the art during the course of the following description of the invention.

DETAILED DESCRIPTION OF THE INVENTION

Figure 1:
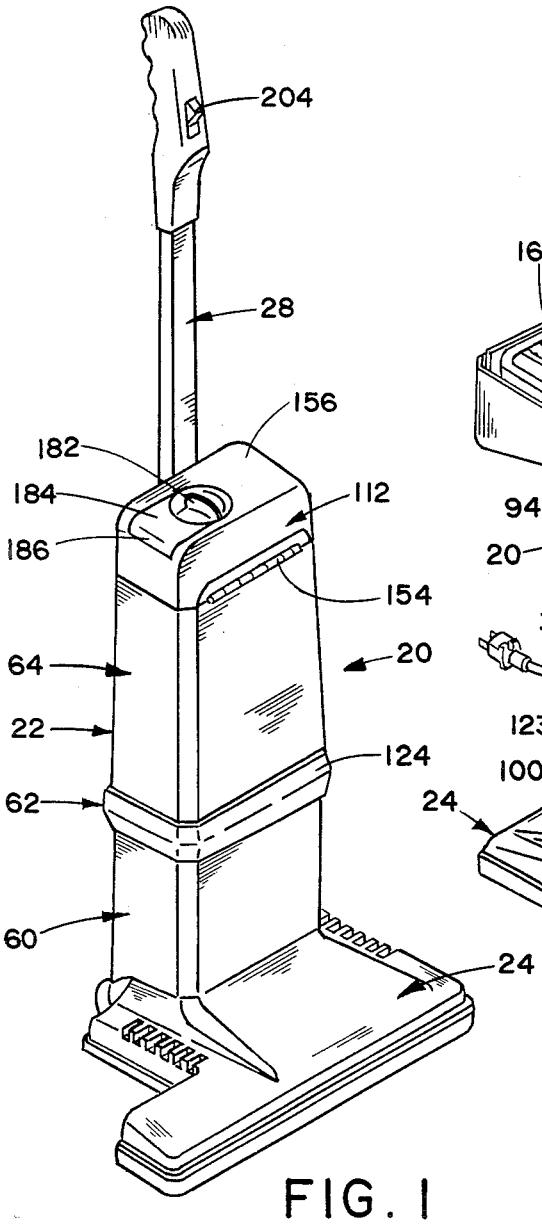
FIG. 1 is a front perspective view of an upright vacuum cleaner embodying our invention.
Figure 2:
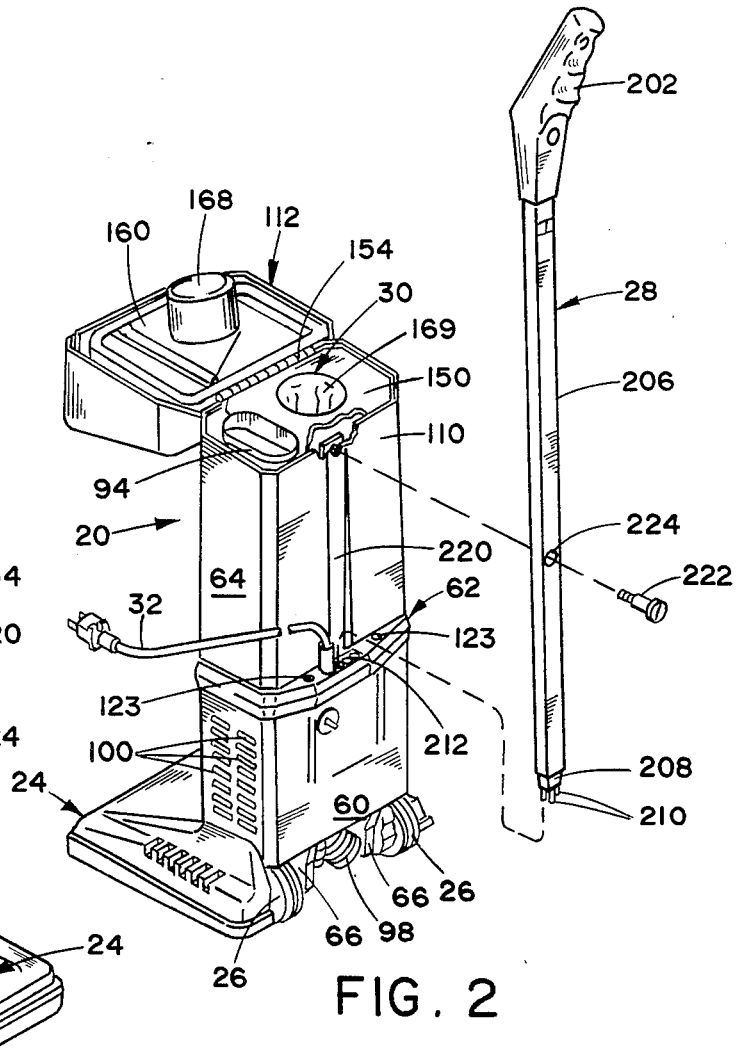
FIG. 2 is an exploded rear perspective view of the vacuum cleaner of FIG. 1 showing the closure assembly in an open position.

Referring to the drawing and initially to FIGS. 1 and 2, a vacuum cleaner indicated generally by the numeral 20 includes a housing 22, a base assembly 24, rear wheels 26, a handle assembly 28, a filter bag 30, and an electrical cable 32.

Figure 3:
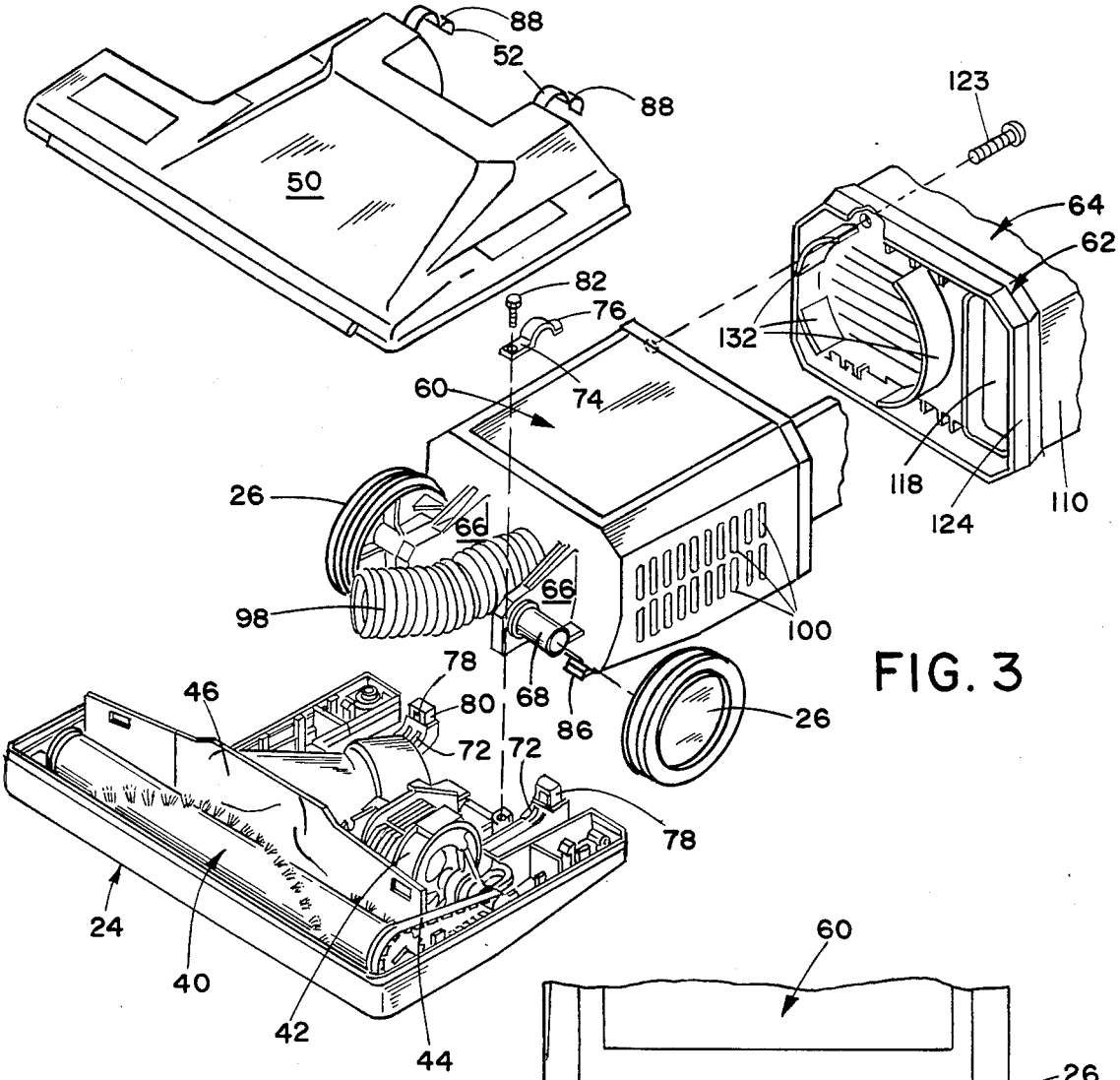
FIG. 3 is an enlarged exploded perspective view of the lower portions of the vacuum cleaner.
Figure 4:
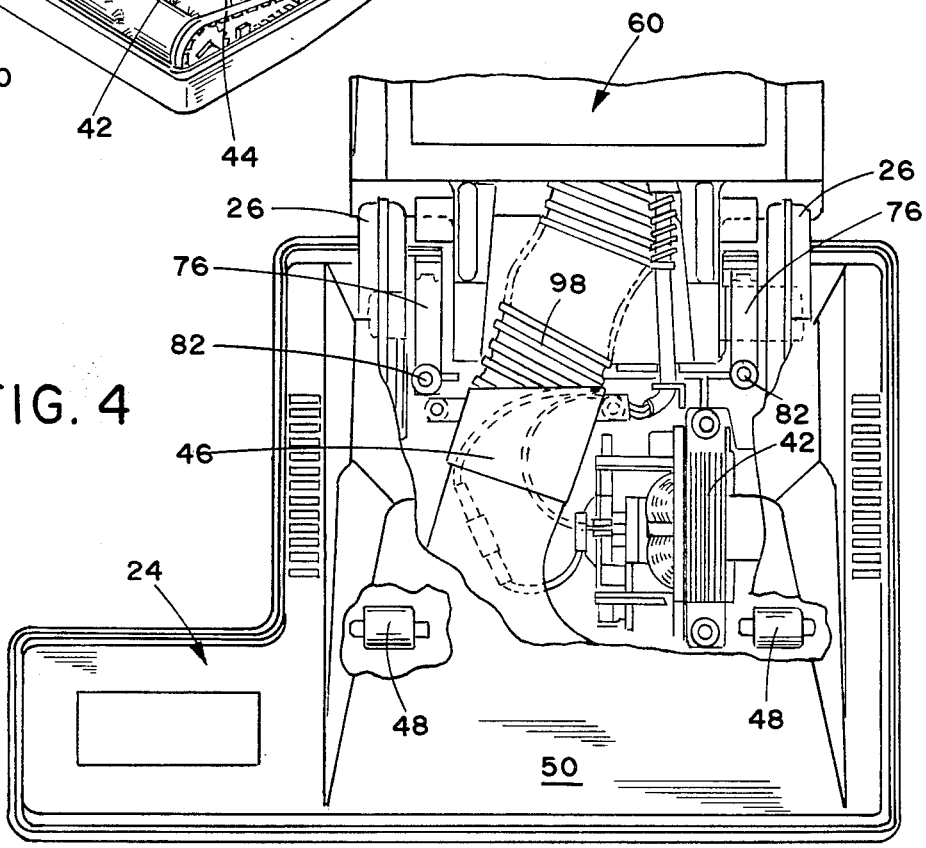
FIG. 4 is an enlarged top plan view of the vacuum cleaner base assembly with portions broken away.

The base 24, FIGS. 3 and 4, includes a brush 40 driven by a motor 42 through belt 44. Directly behind the brush is a suction nozzle 46. Front rollers 48 support the forward portion of the base assembly a prescribed distance above a surface to be cleaned. A cover 50 encloses the brush, brush motor and suction nozzle, and also support a pair of spring members 52, the function of which will be subsequently described.

The housing 22 includes a motor body housing assembly 60, a bulkhead assembly 62, a filter bag housing assembly 64, and a cover or body closure assembly 112. Depending from and integral with the lower portions of the motor body housing assembly are a pair of spaced parallel supports 66 having extending therefrom trunnions 68 for mounting of the rear wheels 26.

The trunnions 68 are received within sockets 72, FIG. 3, on the base assembly 24 and retained therein by wheel clamps 74. An end portion 76 of each clamp is received within a recess 78 in a post defining the socket 72, and the opposite end is secured to a post by the fastener 82. Mounting of the base assembly 24 and the motor body housing assembly 60 in this manner permits pivotal displacement of the housing 22 relative to the base 24 between an upright position, as shown by FIGS. 1 and 2, and a generally horizontal position, as shown by FIG. 4.

The housing 22 normally is retained in the FIG. 1 position when the vacuum cleaner is not in use. The casing 90 of the motor housing assembly 60 has a pair of spaced cam members 86 depending from the rear portions thereof for cooperative engagement with the spring members 52 secured to the cover 50 of the base assembly. Note that each spring member 52 defines a curved portion 88 for releasably receiving therein a cam member 86 and for retaining housing 22 in an upright position. The members 86 may be released from the curved spring portions 88 by applying a slight downward pressure to the forward portion of the base assembly 24 while applying a rearward force to the handle assembly 28.

Figure 5:
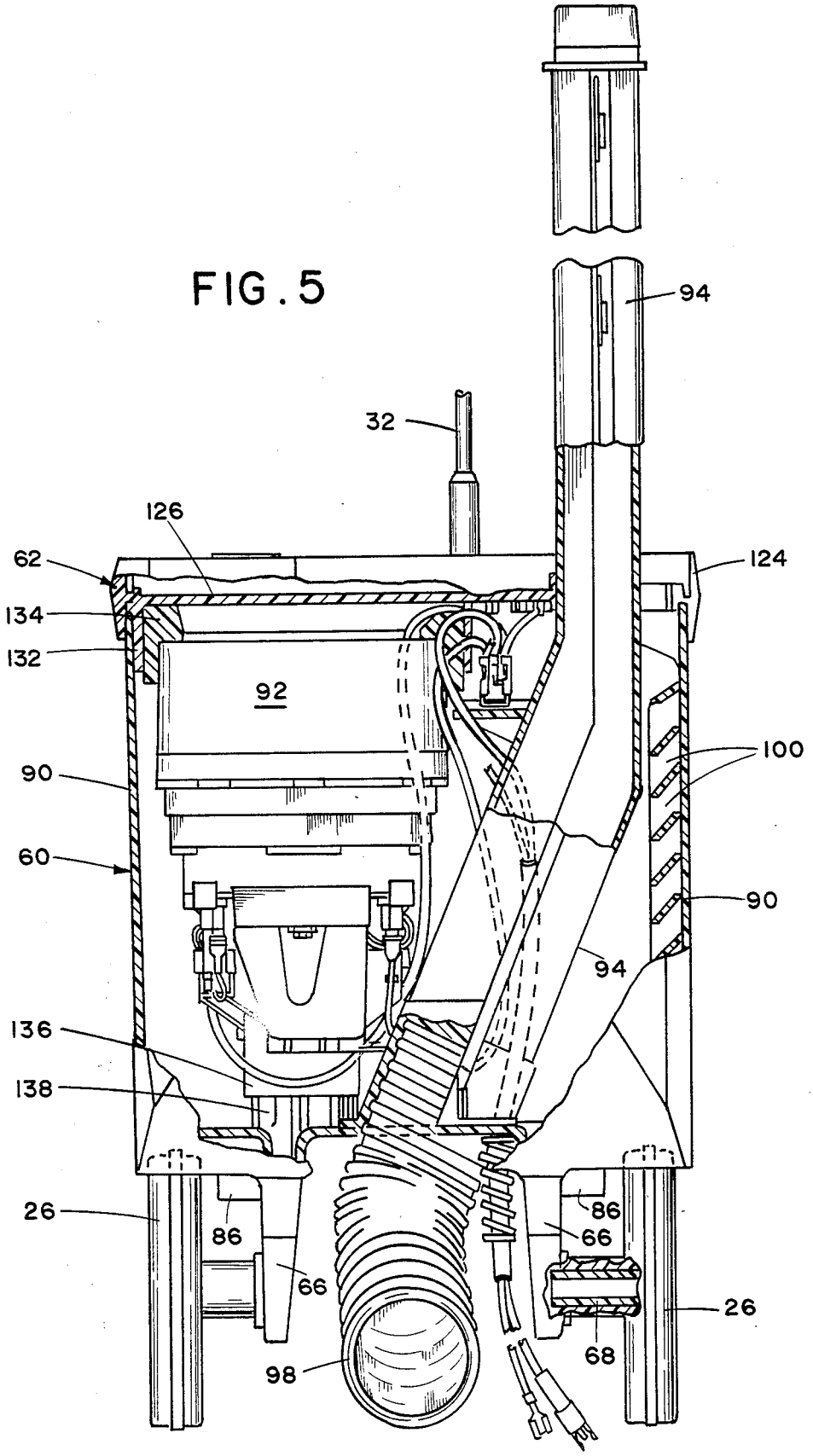
FIG. 5 is an enlarged rear elevational view of the lower portion of the vacuum cleaner with parts broken away and illustrating the rear wheels assembly, the duct assembly, and the motor-fan unit.

The motor housing assembly 60, FIG. 5, includes a molded plastic casing 90 which houses a motor-fan unit and which supports a duct assembly 94. A flexible duct 98 extends through an opening in casing 90 and couples the duct 94 with the outlet end of the suction nozzle 46. The casing 90 also defines therein suitable exhaust openings 100.

Figure 7:
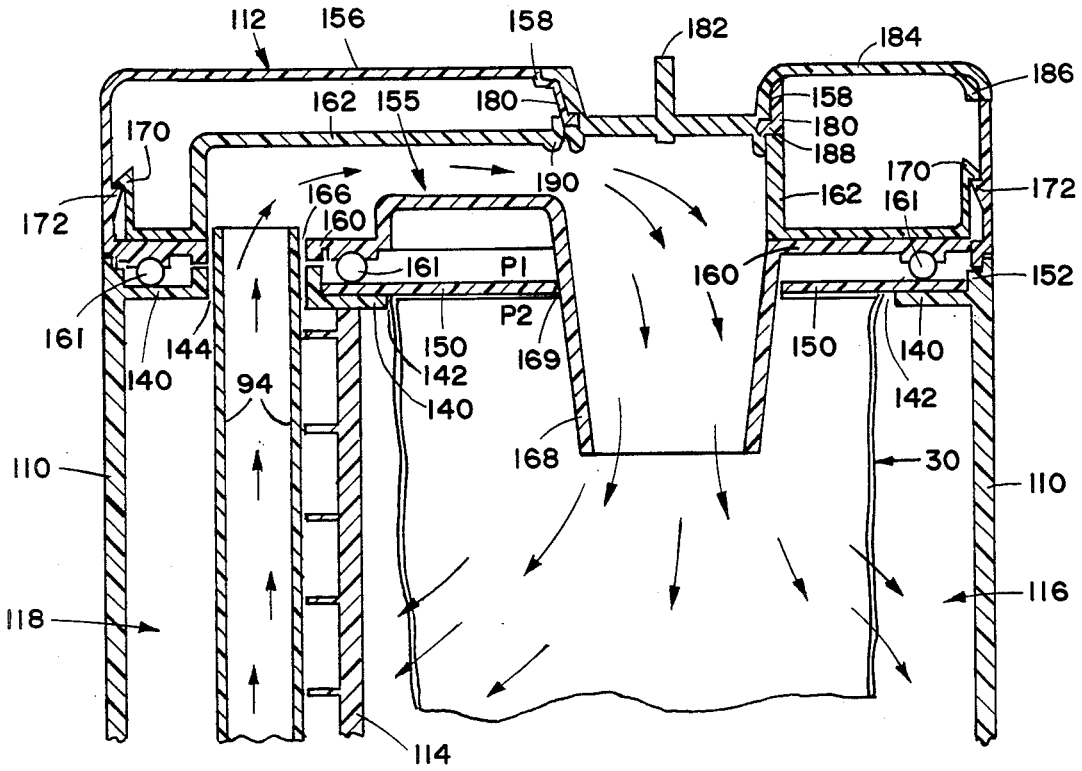
FIG. 7 is an enlarged, fragmentary, cross-sectional view of the upper portion of the vacuum cleaner including the cover assembly, the bag housing, the filter bag, and the duct assembly.
Figure 8:
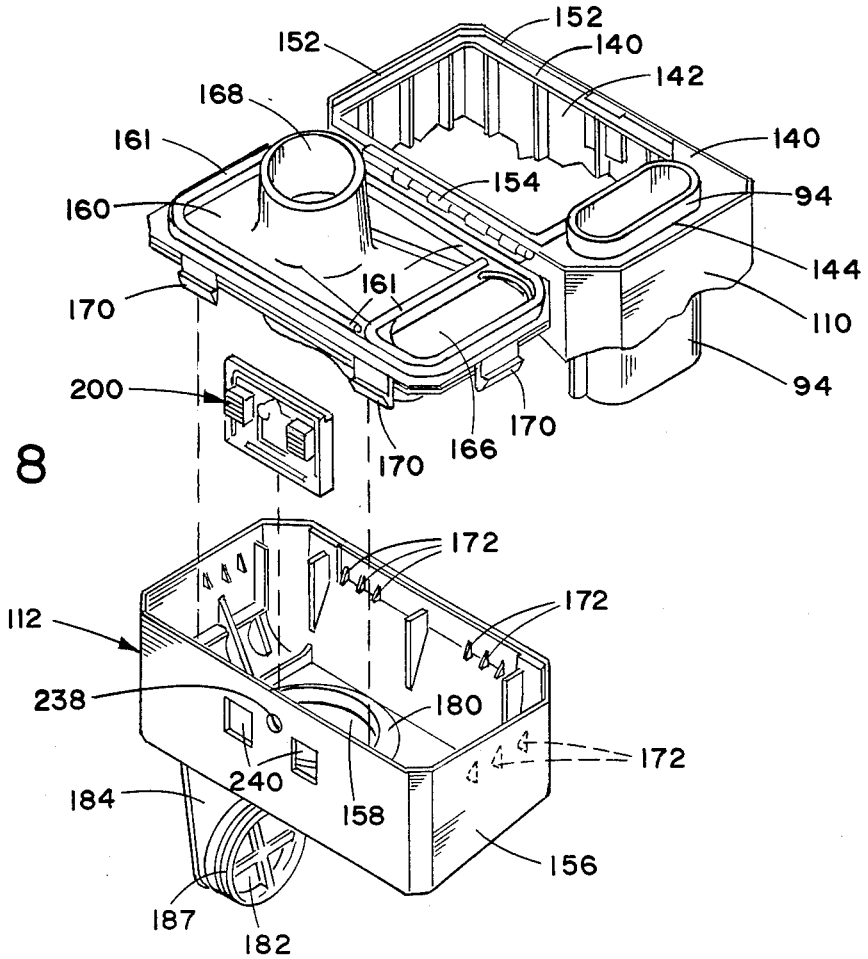
FIG. 8 is a fragmentary perspective view of the upper portion of the vacuum cleaner illustrating the cover assembly and cover assembly latch in exploded relation.

The bag housing assembly 64, FIGS. 2, 7, and 8, includes a plastic casing 110 and a vertical panel 114 which serves to define two separate and distinct chambers, a vacuum chamber 116 for receiving the filter bag 30, and an atmospheric chamber 118 for receiving the duct 94. The panel 114 and the duct 94 also are preferably of plastic construction.

Figure 10:
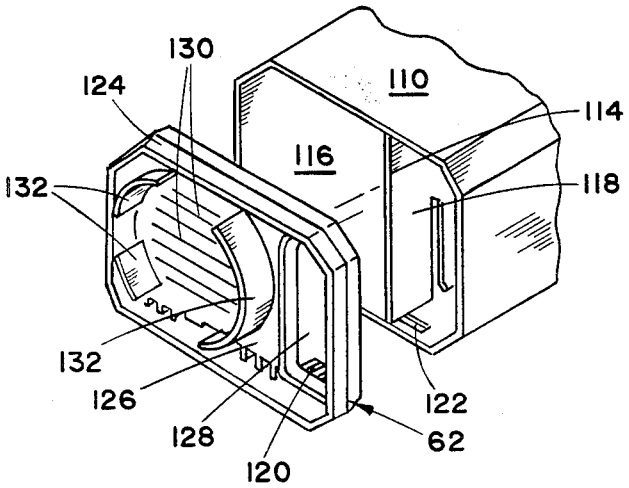
FIG. 10 is a fragmentary exploded view of the bulkhead assembly and the bag housing assembly.

The body bulkhead assembly 62, shown most clearly in FIGS. 2, 3, 5, and 10, is secured to the casing 110 of assembly 64 by a series of interlocking hook-like members 120, 122; only one of each has been shown in FIG. 10. In the preferred embodiment, the members 120, 122 are integral with the casing 110 or the assembly 62, and when the casing 110 and assembly 62 are displaced relative to each other, the members 120, 122 snap into locking engagement. The bulkhead assembly 62 is releasably secured to the motor housing assembly by suitable screw fasteners 123, two of which have been shown in FIG. 2, and one of which has been shown in FIG. 3.

Figure 6:
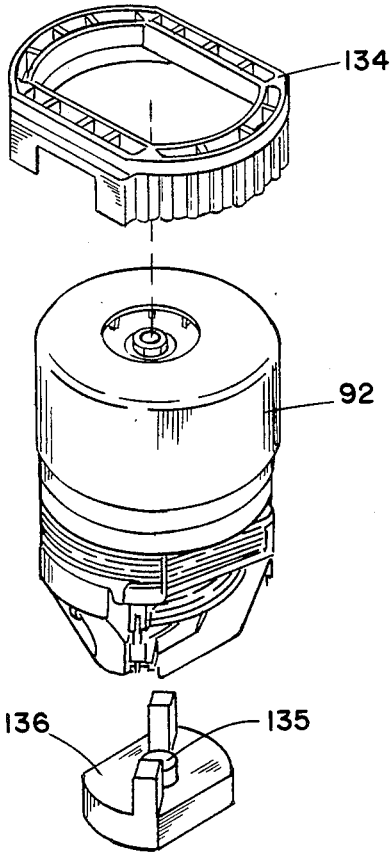
FIG. 6 is an enlarged perspective view of the motor-fan unit with upper and lower mounts spaced therefrom.

The bulkhead assembly 62 includes a peripheral band 124 defining opposed slots therein, FIG. 5, for receiving and overlapping portion of the casings 90 and 110. The assembly 62 also includes a plate 126, preferably formed of plastic, having a first opening 128 therein for receiving the duct 94, and a series of openings 130 for permitting the motor-fan unit to communicate with the vacuum chamber 116. Depending from the plate 126 are a plurality of integral retaining members 132 arranged generally as shown in FIGS. 3, 5, and 10, and which receive and retain a rubber mount 134, FIGS. 5 and 6, for confining and limiting movement of the upper portion of the motor-fan unit 92. The lower portion of the motor-fan unit is received and retained within the opening 135 of a rubber mount 136 which, in turn, is supported upon upstanding portions 138 integral with the plastic casing 90. Thus the vacuum motor-fan unit 92 is suspended and isolated by the flexible rubber mounts 134, 136.

The filter bag housing assembly 64 also includes adjacent the upper end of the casing 110 an integral plate 140, FIGS. 7 and 8, having spaced first and second openings 142 and 144 therein. Opening 144 has a configuration and size conforming to the cross-sectional configuration of the upper portion of the duct 94 for receiving the duct and closing the upper end portion of chamber 118. Portions of the plate 140 extending outwardly of the opening 142 serve as a support for the disk 150 of a disposable air filter bag 30. The size and configuration of the disk 150 are such that the outer peripheral edges generally abut or are in close proximity to the inner peripheral edges 152 of the upper portions of the casing 110 when the disk 150 is supported upon plate 140.

The cover assembly 112 is pivoted relative to the casing 110 by a hinge 154. The cover assembly 112 includes an outer casing 156 having portions defining an access port 158 therein, an inner member 160, and an intermediate member 162 secured to member 160 by suitable interlocking snap fasteners, not shown. Inner member 160 has a first opening 166 therein for receiving the upper portion of duct 94 and also includes portions defining a discharge nozzle 168 for depending through an opening 169 in the bag disk 150 and into the filter bag. The member 160 also defines a recessed track for receiving therein a suitable sealing means 161, which may be of one-piece construction. The seal 161 extends around the opening 166 and the upper portion of duct 94 and also around the outer peripheral portions of member 160 for encompassing the discharge nozzle 168 but being in spaced rotation to the nozzle 168.

The outer casing 156 and the intermediate member 162 are held in assembled relation by interlocking hook snap fasteners 170, 172. Portions of the inner member 160 and the intermediate member 162 cooperate to define an air passage or duct 155 and the nozzle 168 for directing the flow of dirty air from duct 94 into the filter bag 30, as shown by FIG. 7.

The outer casing 156 includes portions 180 defining the port 158 for permitting access to the filter nozzle 168. The port 158 may be sealed by a closure 182 attached to an integral hinge 184 which is secured adjacent to the end portion 186 by suitable interlocking fastening means to the casing 156. Preferably the closure 182 and hinge 184 are of integral plastic construction with the hinge being of thin, flexible construction. The casing 156 is recessed adjacent the hinge 184 such that the hinge and the top of closure 182 are substantially flush with uppermost portions of casing 156. The closure 182 includes a ring-like recess 187 which is adapted to releasably snap over a continuous circular projection 188 of casing 156 and 190 of the intermediate member 162 to normally seal the port when the vacuum cleaner is used to clean flooring. When the cleaner is used for above-the-floor cleaning the closure 182 is opened to provide access to the port for attachment of an accessory hose, not shown, thereto.

Figure 9:
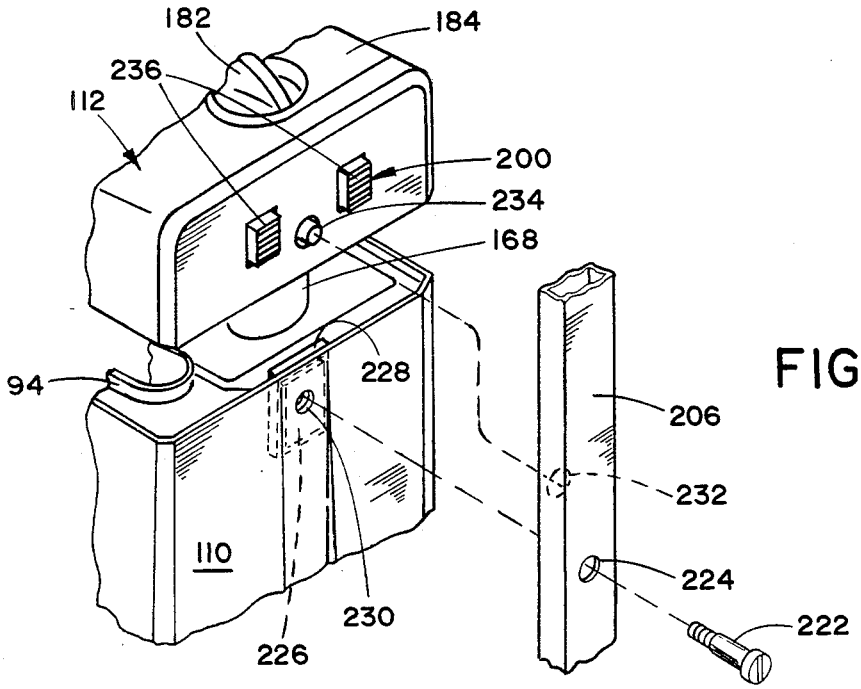
FIG. 9 is a fragmentary perspective view of the vacuum cleaner illustrating the closure assembly in partially opened relation, the closure assembly latch, and fastening means for mounting the handle assembly.

The pivotable cover assembly 112 includes a latch assembly 200, FIGS. 8, 9, which cooperates with the handle assembly 28 in a manner to be described subsequently for normally locking the cover assembly in a sealed manner.

Figure 12:
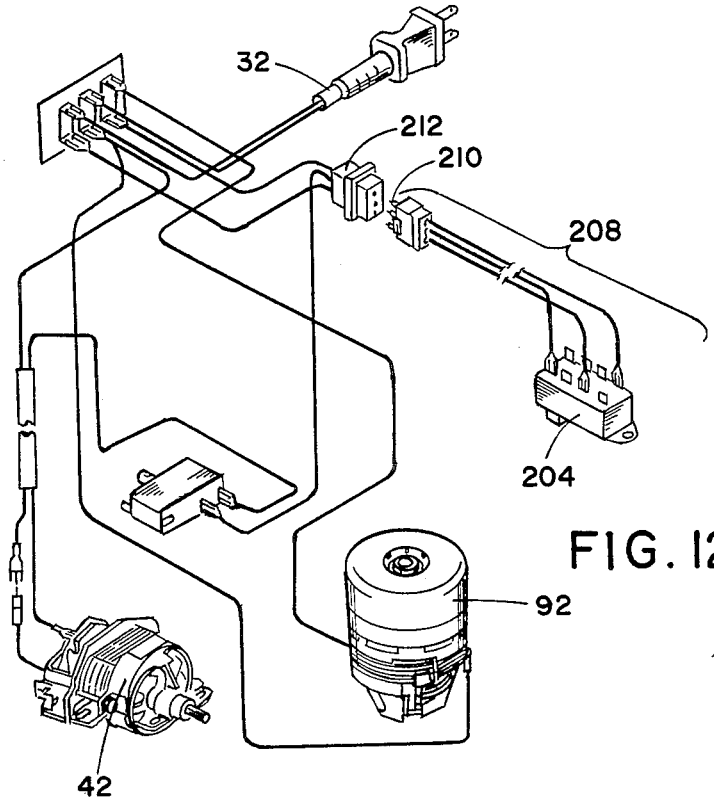
FIG. 12 is an electrical wiring diagram.

The handle assembly 28 includes a hand grip portion 202 which houses a switch 204 and a hollow elongated portion 206 which houses an electrical wiring harness 208 having a projection including prongs 210 adapted to be releasably received within a receptacle 212 supported by the bulkhead assembly 62. The receptacle is connected in a conventional manner, FIG. 12, to motors 42 and 92 and power cord 32.

A portion of the casing 110 of the filter bag housing assembly 64 is recessed at 220, FIG. 2, for receiving a portion of the elongated handle 206. The handle assembly 28 is attached to the casing 110 by a fastener 222 which passes through an opening 224 in the handle 206 and through an opening 230 within the casing 110, and is threaded to a generally rectangular plate 226 which is received within a vertical slot or recess 228 formed in the casing 110. The width of the plate 226 and the width of the slot 228 generally are the same so as to prevent rotation of the plate within the slot.

Figure 11:
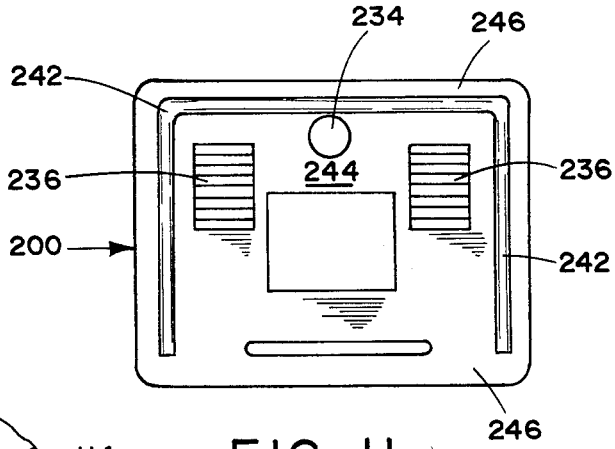
FIGS. 11 is an enlarged plan view of the cover assembly latch.

The hollow handle 206 also has surfaces defining an opening 232 for receiving a projection 234 of the latch 200 and normally lock the cover assembly 112 in the closed position. The latch 200 preferably is of one-piece construction, as shown by FIG. 11, and in the embodiment illustrated is of plastic construction. The latch is suitably secured to the casing 156 with the projection 234 and projections 236, 236 extending through openings 238 and 240 in the casing 156, and in the preferred embodiment is slidably received with a slot defined by the casing 156.

Referring to FIG. 11, the latch 200 defines an inverted, generally U-shaped slot which extends about three sides of the projections 234, 236 which permits limited displacement of the plate portion 244, which carries the projections 234 and 236 relative to the rigid frame portion 246. The frame 246 is attached to the casing 156 as indicated above. With the closure assembly 112 in the closed, sealed position, the projections 236, 236 project on each side of the handle portion 206 and the projection 234 projects into opening 232 in handle portion 206. One or both of the projections 236, 236 is adapted to be pressed inwardly to release the projection 234 from opening 232 and permit the cover assembly 112 to be pivoted about hinge 154 to an open position, thus providing access to the filter bag 30.

The switch 204 is adapted to energize the motor-fan unit 92 alone, or to energize both motor-fan unit 92 and the brush motor 42. When the motor-fan unit 92 is actuated, dirt-laden air is drawn through the suction nozzle 46, flexible duct 98, duct 94, into the closure assembly 112 which defines duct 155 and discharge nozzle 168 and into a filter bag 30. Clean air is drawn from the bag 30, through the openings 130 in the bulkhead assembly, and to the fan entrance of the motor-fan unit.

A conventional method of providing a seal between the vacuum duct and the filter bag is to immediately surround the nozzle projecting into the bag opening with a flexible gasket which bears against the disk to provide a seal. This has a detrimental effect in that the seal applies a force against an unsupported portion of the disk adjacent the discharge nozzle which tends to bend or deform the disk. Also, the difference in air pressure on opposite sides of the disk tends to further deform the disk, thus providing air leakage about the seal.

In the novel sealing concept of the instant invention, FIGS. 7 and 8, no seal is provided in surrounding engagement with the nozzle 168, thus eliminating pressure to unsupported portions of the disk 150 adjacent disk opening 169. All sealing is within one plane. The seal 161, attached to member 160, extends around the opening 166 and duct 94 and around the outer upper peripheral edges of the bag disk 150. Thus the disk is clamped between the seal 161 and the plate portions 140 and becomes an integral part of the vacuum chamber seal. Since an airtight seal between the nozzle 168 and the disk edges defining opening 169 is eliminated, the pressure P1 and P2 on opposite sides of the disk will be equal, eliminating any force tending to bend or pull the disk into vacuum chamber 116. Normally there is sufficient leakage of air between the disk and the nozzle 168 to permit P1 and P2 to be equal. However, if required, a small opening could be provided in the disk 150.

Although a preferred embodiment of the invention has been described in detail, it is contemplated that various modifications and equivalents may be made within the spirit and scope of the invention.

We claim:

1. In a lightweight, upright vacuum cleaner, a base assembly including a suction nozzle, an elongated body housing, means attaching said body housing to said base assembly for pivotable movement relative thereto, said body housing including a motor housing assembly, a bulkhead assembly, a filter bag housing assembly, and a body closure assembly, means for securing said motor housing assembly, said bulkhead assembly and said filter bag housing assembly in assembled relation, means pivotably mounting said body closure assembly on said filter bag housing assembly, said filter bag housing assembly defining a vacuum chamber, air filter means supported within said vacuum chamber and including an apertured disk having an air-permeable bag secured thereto, said filter bag housing assembly including means for supporting said apertured disk adjacent outer peripheral edge portions, said body closure assembly including a duct terminating in a discharge nozzle, and seal means spaced substantially outwardly of said nozzle for applying a force to the outer peripheral edges of said disk to clamp and seal said disk between said seal means and said means for supporting said disk, elongated duct means extending between said suction nozzle and said body closure assembly duct means, a motor-fan unit mounted within said motor housing assembly for drawing an air stream through said suction nozzle, said elongated duct means, said body closure assembly duct and said air filter means to remove dust and dirt particles from said airstream, an elongated handle assembly, means supported by said bulkhead assembly for releasably receiving therein the lowermost end portion of said handle assembly, said handle assembly further including means for retaining said body closure assembly in a closed position.

2. A vacuum cleaner as recited in claim 1 wherein said means supported by said bulkhead assembly for releasably receiving therein the lowermost end portion of said handle assembly comprises an electrical receptacle, and said lowermost end portion of said handle assembly includes projecting electrical connectors of a wiring harness.

3. A vacuum cleaner as recited in claim 1, and further including means for releasably securing said handle assembly to said filter bag housing assembly.

4. A vacuum cleaner as recited in claim 3, said filter bag housing assembly including an outer casing having surfaces defining a vertical slot therein, said means for releasably securing said handle assembly to said filter bag housing assembly including a plate having a threaded aperture supported in said vertical slot and a fastener extending through said handle assembly and into said plate.

5. A vacuum cleaner as recited in claim 1, said body closure assembly including latch means including a spring-biased projection, said handle assembly means for retaining said body closure assembly in a closed position including an opening therein for receiving said spring-biased projection, and means for displacing said projection from said opening to permit said body closure assembly to be displaced to provide access to said air filter means.

6. A vacuum cleaner as recited in claim 1, said means attaching said body housing to said base assembly for pivotable movement relative thereto including wheel supporting trunnions attached to said motor housing assembly, said base assembly including sockets for receiving therein portions of said trunnions, and means for retaining said portions of said trunnions in said sockets.

7. A vacuum cleaner as recited in claim 6, said body closure assembly further including means defining a port therein and closure means for selectively providing access to said vacuum chamber.

8. A vacuum cleaner as recited in claim 7 wherein said port closure means is aligned with said discharge nozzle, said port closure means being of flexible plastic construction.

9. A vacuum cleaner as recited in claim 1, said bulkhead assembly and said filter bag housing assembly being of plastic construction, said means for securing said motor housing assembly, said bulkhead assembly and said filter bag housing assembly in assembled relation including interlocking snap fasteners.

10. A vacuum cleaner as recited in claim 9 wherein said snap fasteners include interlocking hook portions.

* * * * *

US004724574C1

(12) EX PARTE REEXAMINATION CERTIFICATE (6512th)

United States Patent
Bowerman et al.

(10) Number: US 4,724,574 C1
(45) Certificate Issued: Nov. 11, 2008

(54) SUCTION CLEANER

(75) Inventors: Leonard E. Bowerman, Abingdon, VA (US); Daniel A. Peragine, Mt. Vernon, NY (US); George C. Moyher, Bluff City, TN (US)

(73) Assignee: Aerus LLC, Dallas, TX (US)

Reexamination Request:
No. 90/008,008, Apr. 18, 2006

Reexamination Certificate for:

| | |
|---|---|
| Patent No.: | **4,724,574** |
| Issued: | **Feb. 16, 1988** |
| Appl. No.: | **07/028,178** |
| Filed: | **Mar. 19, 1987** |

(51) Int. Cl.

| | |
|---|---|
| ***A47L 5/28*** | (2006.01) |
| ***A47L 9/10*** | (2006.01) |
| ***A47L 9/14*** | (2006.01) |

(52) U.S. Cl. ..... 15/351; 15/410; 15/412; 55/373; 55/378; 55/DIG. 3

(58) Field of Classification Search ..... None

See application file for complete search history.

(56) References Cited

U.S. PATENT DOCUMENTS

| | | | |
|---|---|---|---|
| 2,269,482 | A | 1/1942 | Replogle |
| 3,639,939 | A | 2/1972 | Crener et al. |
| 4,364,146 | A | 12/1982 | Bowerman |
| 4,517,705 | A | 5/1985 | Hug |

OTHER PUBLICATIONS

Instruction Manual; Hako Minuteman Model 140 Carpet Vacuum, no date.

*Primary Examiner*—Terrence R Till

(57) ABSTRACT

A lightweight, upright, top-loading vacuum cleaner wherein a seal between the disk of a filter bag and a duct for conveying dirt-laden air to the bag is provided adjacent the outer peripheral edges of the disk resulting in the disk becoming an integral part of the seal while eliminating pressure differential across opposite sides of the disk. A portion of the duct extending into the filter bag is capable of being displaced to an open position for filter bag loading and unloading and is normally closed to maintain the seal by a latch which cooperates with the handle vacuum cleaner handle. The vacuum cleaner handle includes electrical components having projections which are releasably received and supported within an electrical receptacle supported by the vacuum cleaner housing.

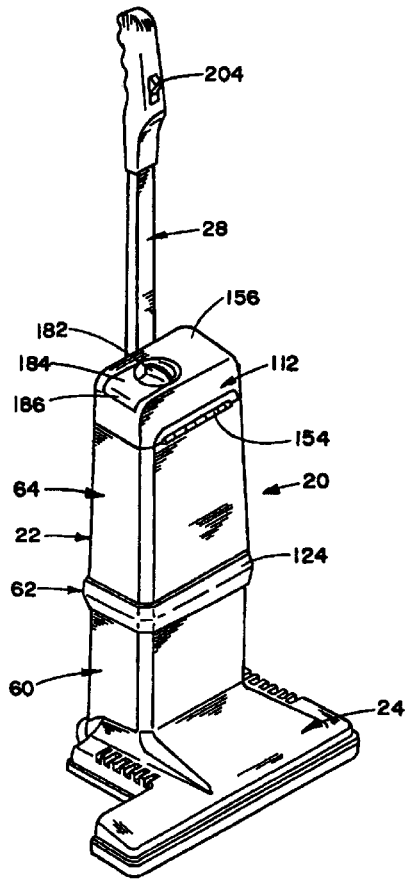

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–10 is confirmed.

* * * * *